US005881512A

United States Patent [19]

Chang

[11] Patent Number: 5,881,512

[45] Date of Patent: Mar. 16, 1999

[54] PRECASTED WALL/COLUMN MODULE

[76] Inventor: Houn-I Chang, No. 468, Hsi Tou Rd., Hsi Pan Village, Hsi Chou Hsiang, Chang Hua Hsian, Taiwan

[21] Appl. No.: 25,494

[22] Filed: Feb. 18, 1998

[51] Int. Cl.[6] ..... E04C 2/52; E04B 2/08

[52] U.S. Cl. ..... 52/220.2; 52/505; 52/592.6; 52/604; 52/607; 52/722.1; 52/726.3

[58] Field of Search ..... 52/220.2, 503, 52/505, 592.6, 726.5, 726.3, 604, 607, 721.2, 722.1, 723.1, 726.4, 220.3

[56] References Cited

U.S. PATENT DOCUMENTS

| | | | |
|---|---|---|---|
| 938,140 | 10/1909 | Goucher | 52/726.5 |
| 1,209,936 | 12/1916 | Campfield | 52/722.1 X |
| 1,571,387 | 2/1926 | Vorrhees | 52/722.1 X |
| 1,841,807 | 1/1932 | Harter | 52/505 X |
| 2,128,463 | 8/1938 | Kauffmann | 52/726.5 |
| 3,391,506 | 7/1968 | Gusner et al. | 52/722.1 X |
| 5,291,711 | 3/1994 | Kopaz | 52/503 |

FOREIGN PATENT DOCUMENTS

| | | | |
|---|---|---|---|
| 244795 | 5/1947 | Sweden | 52/592.6 |

*Primary Examiner*—Robert Canfield
*Attorney, Agent, or Firm*—Pro-Techtor International Services

[57] ABSTRACT

Disclosed is a precasted wall/column module including a hollow body formed from a four-side outer frame and an inscribed round pipe. The outer frame has an upper end forming a first axially projected flange extending along an inner edge of the upper end and a lowered outer edge extending around the first flange, and a lower end forming a second axially projected flange extending along an outer edge of the lower end and a lowered inner edge extending along an inner side of the second flange. Axially extended insertion holes are correspondingly formed at every corners of the upper and lower ends to receive insertion bars for connecting the modules to one another. A thinned area can be selectively provided on either side of the outer frame. Two semicircular openings are separately formed at upper and lower edges of each thinned area and a plurality of round holes are spaced between the two semicircular openings.

1 Claim, 4 Drawing Sheets

PRECASTED WALL/COLUMN MODULE

BACKGROUND OF THE INVENTION

The present invention relates to a precasted wall/column module, and more particularly to a precasted hollow module with preformed holes to provide passages for mounting conduits and other construction materials to simplify and speed the construction of walls and columns.

There are two conventional ways for constructing a wall or column. The first way is by laying bricks. After the brick wall or column is completed, the wall or column might need to be locally bored or knocked off to mount conduits and then be repaired with primary cement grout and be screeded. After the primary cement grout has become dried, the wall or column is finished with fine cement grout or other construction materials, such as tiles, marble slabs, or metal panels. The second way is by grouting concrete. In this way, bar reinforcement and templates must be erected before grouting. After the concrete is set, the templates must be removed and the wall or column must be finished with fine cement grout or other construction materials, just as in the case of brick wall and column. The conventional way of constructing a wall or column by laying bricks includes complicated and time-consuming steps while the water and electric wire conduits can not be easily mounted in the wall. And, the conventional way of constructing a wall or column by grouting also includes complicate steps and difficult subsequent works to finish fissures and scars caused by templates. Any negligence will cause uneven wall surface. It is therefore tried by the inventor to develop a precasted wall/column module to avoid disadvantages of the conventional ways of constructing walls and columns.

SUMMARY OF THE INVENTION

A primary object of the present invention is to provide a precasted wall/column module which can be easily stacked on another one in a labor and time saving manner while an enhanced construction quality and performance can be achieved.

Another object of the present invention is to provide a precasted wall/column module which can be easily fitted together to conveniently provide conduit passages in walls or columns to avoid boring or repairing of the walls or column later.

BRIEF DESCRIPTION OF THE DRAWINGS

The above objects and the technical means adopted by the present invention to achieve the objects can be best understood by referring to the following detailed description of the preferred embodiments and the accompanying drawings, wherein.

DETAILED DESCRIPTION OF THE PREFERRED EMBODIMENTS

Figure 1:
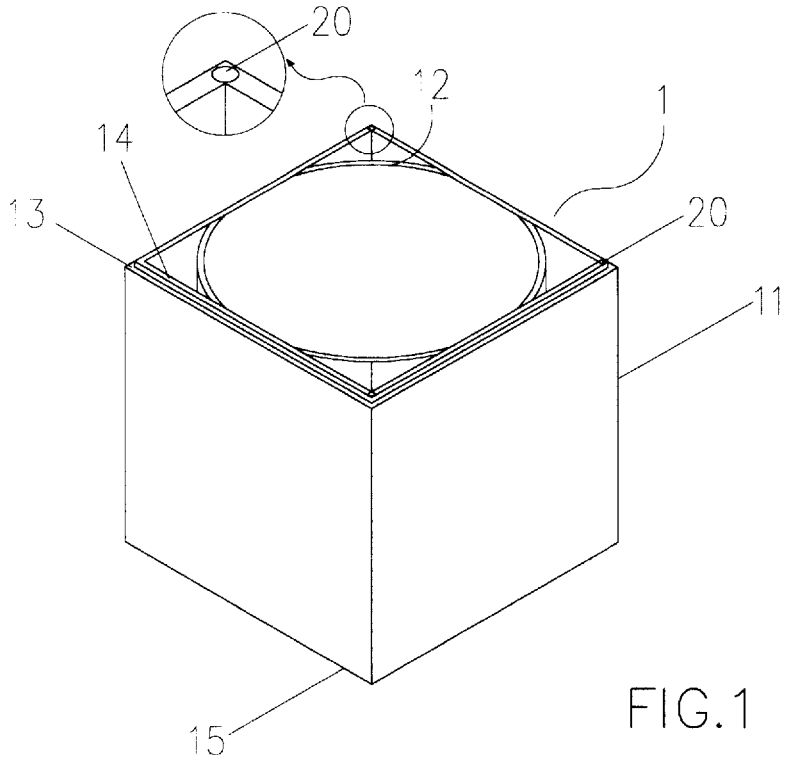
FIG. 1 is a perspective view showing a basic form of the precasted wall/column module according to the present invention.

Please refer to FIG. 1 which is a perspective of a basic form of the present invention. As shown, a precasted wall/column module 1 according to the present invention is a hollow body basically formed from a four-side outer frame 11 and an inscribed round pipe 12. Epoxy resin may be applied over surfaces of the outer frame 11 for paving tiles 3.

An upward projected flange 14 is formed along a top inner edge of the outer frame 11, so that a lowered top outer edge 13 is formed around the flange 14. On the other hand, a downward projected flange 15 is formed along a bottom outer edge of the outer frame 11, giving the outer frame 11 a lowered bottom inner edge 16. Axially extended insertion holes 20 are correspondingly formed at every corners at top and bottom ends of the four-side outer frame 11.

Figure 2:
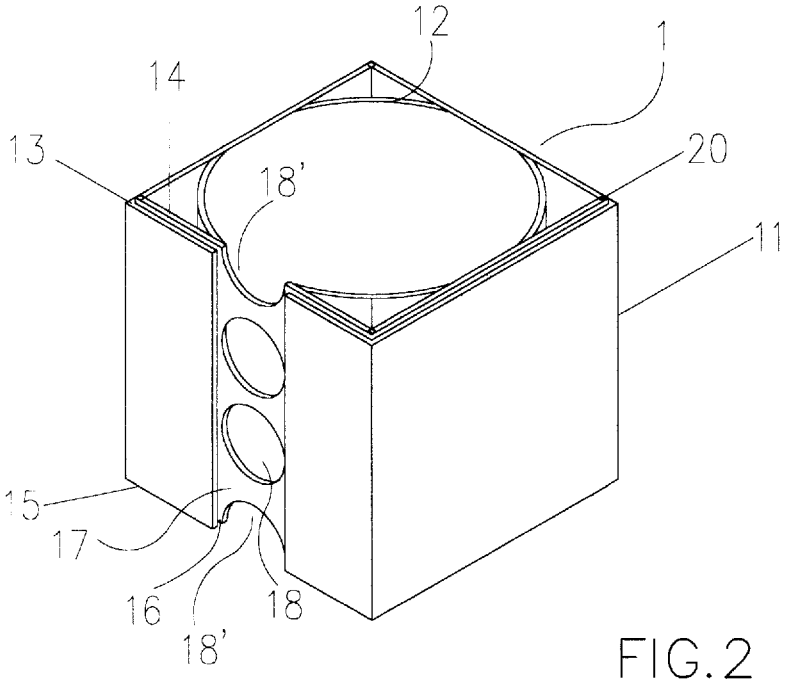
FIG. 2 is a perspective of a first embodiment of the present invention.
Figure 3:
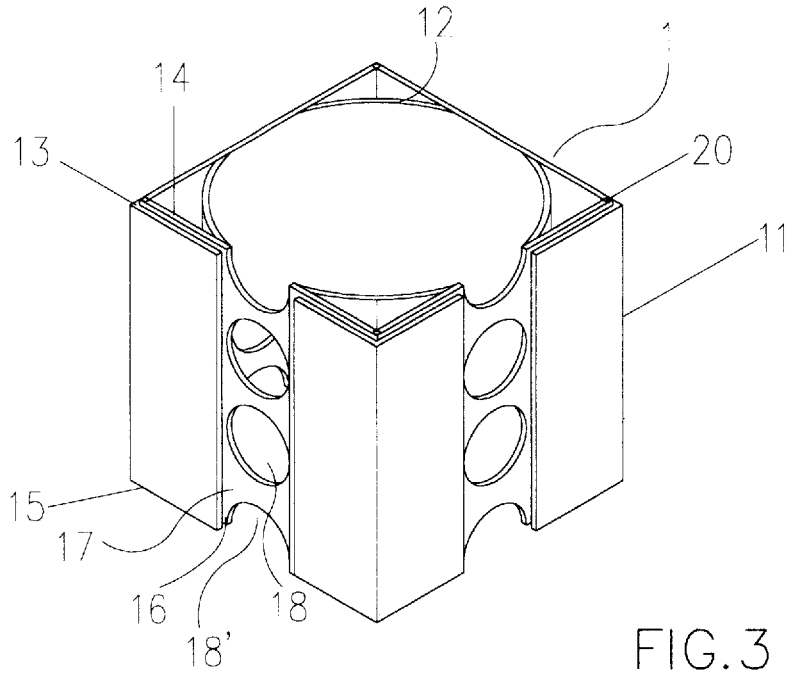
FIG. 3 is a perspective of a second embodiment of the present invention.
Figure 4:
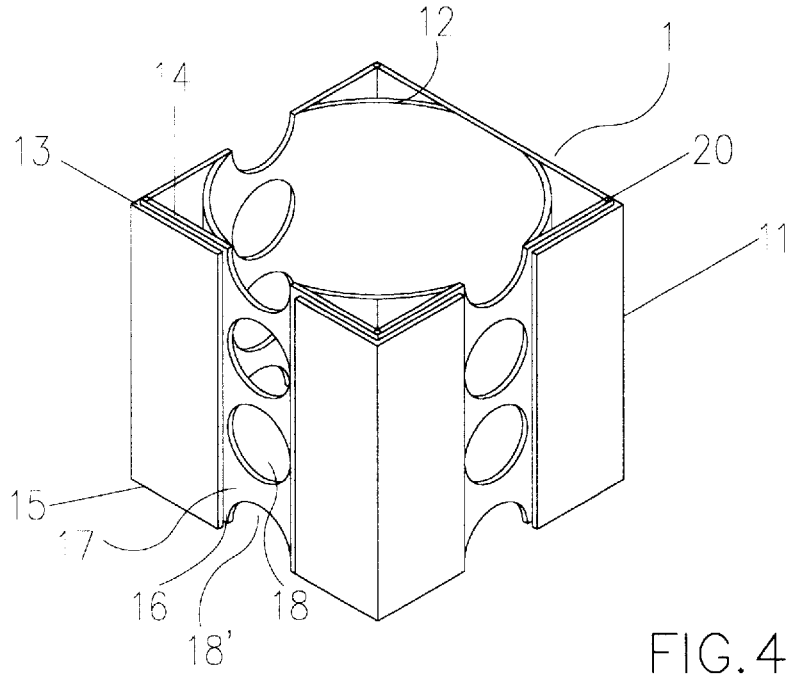
FIG. 4 is a perspective of a third embodiment of the present invention.
Figure 6:
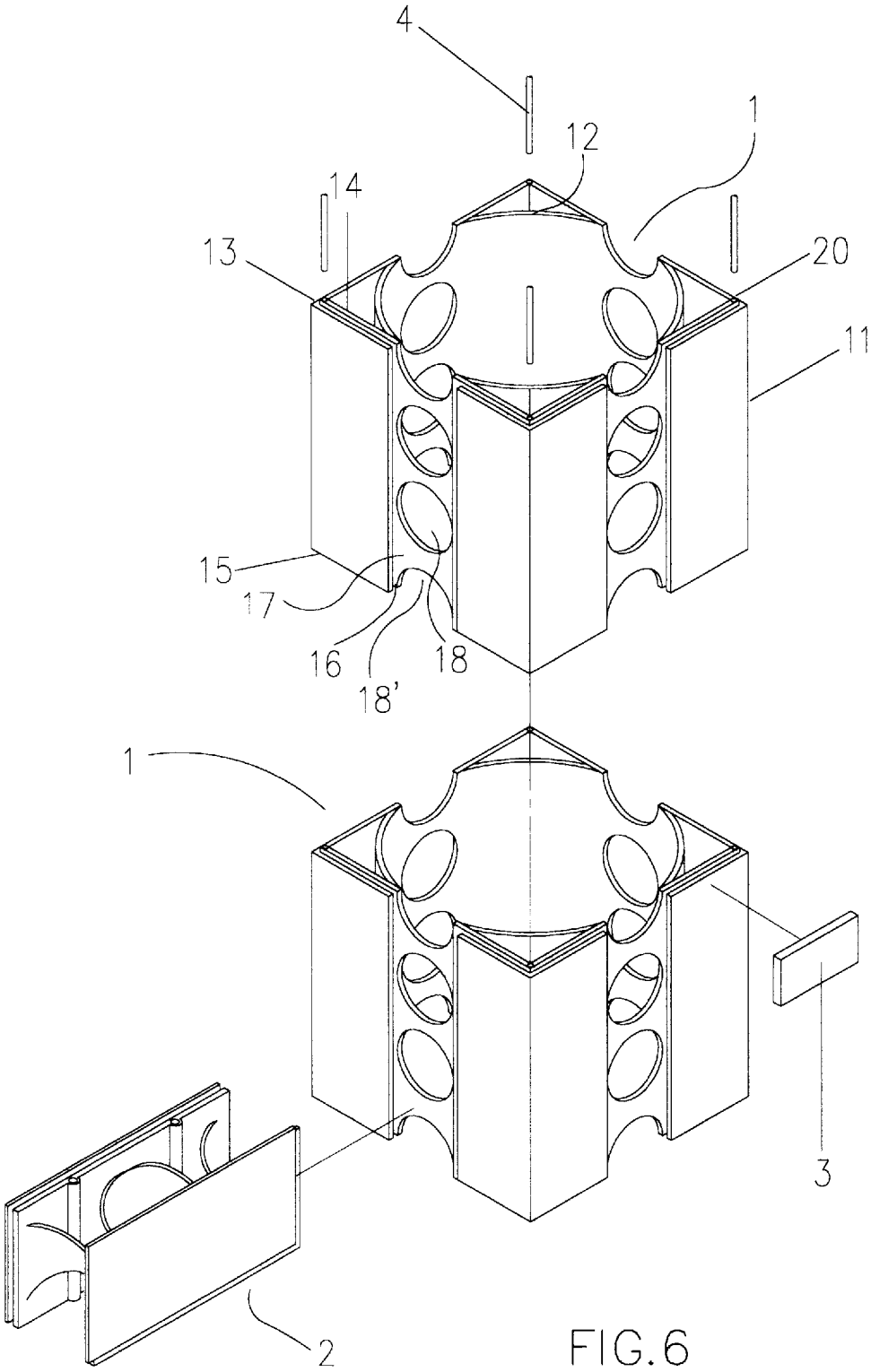
FIG. 6 illustrates a fourth embodiment of the present invention and the manner in which the wall/column modules are fitted together.

FIGS. 2 to 4 illustrate three embodiments of the module 1. In the first embodiment shown in FIG. 2, the module 1 is provided at middle portion of one side of the outer frame 11 with a thinned area 17. Two semicircular openings 18' are formed at upper and lower edges of the thinned area 17 and a plurality of round holes 18 are spaced between the two semicircular openings 18', making the inscribed round pipe 12 communicable with outside. An upper and a lower semicircular openings 18' separately on two modules 1 together form a complete round hole 18. Water and electric wire conduits and other pipes and metal equipment can be extended through round holes 18 during construction as necessary. In the second embodiment of the module 1 shown in FIG. 3, two sides of the outer frame 11 are provided with thinned areas 17. In the third embodiment of the module 1 shown in FIG. 4, three sides of the outer frame 11 are provided with thinned areas 17. FIG. 6 illustrates a fourth embodiment of the module 1 with four sides of the outer frame 11 provided with thinned areas 17.

Figure 5:
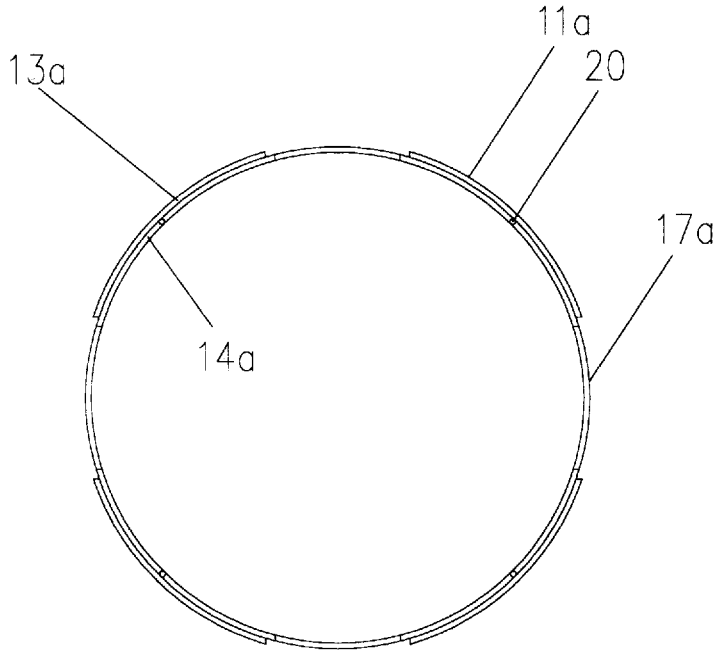
FIG. 5 is a top plan view of a variant form of the present invention.

FIG. 5 is a top plan view of a variant of the module 1. This variant module 1 is formed from a round outer frame 11*a*. An upward projected flange 14*a* is formed along a top inner edge of the outer frame 11*a*, so that a lowered top outer edge 13*a* is formed around the flange 14*a*. On the other hand, a downward projected flange (not shown in FIG. 5) is formed along a bottom outer edge of the outer frame 11*a*, giving the outer frame 11*a* a lowered bottom inner edge (not shown in FIG. 5). Both the upper and the lower ends of the outer frame 11*a* are formed with four axially extended and equally spaced insertion holes 20*a*. One, two, three, or four thinned areas 17*a* can be provided on circumferential surface of the outer frame 11*a* to respectively locate between two adjacent insertion holes 20*a*. Similarly, upper and lower semicircular openings and round holes between the semicircular openings (not shown in FIG. 5) can be formed on each thinned area 17*a*.

Please now refer to FIG. 6 again. In this drawing, two modules 1 with thinned areas 17 and semicircular openings 18' and round holes 18 provided on all four sides of the outer frame 11 are illustrated to show the connection of the modules 1. First superpose a second module 1 on a first module 1 with the upward projected inner flange 14 and the lowered top outer edge 13 at the upper end of the first module 1 engaging with the lowered bottom inner edge 16 and the outer downward projected flange 15 at the lower end of the second module 1, respectively. Meanwhile, insertion bars 4 are inserted into the insertion holes 20 at four corners of the modules 1 to further connect the modules 1 to one another.

Modules 1 with different numbers of thinned area 17 can be selectively used as necessary to form walls and columns of required specifications and dimensions. Precasted bricks 2 with specially designed openings and curves may also be used with the modules 1 of the present invention to successfully provide passages for conduits or other construction material or equipment. After the conduits and the like are mounted in the wall or column formed from the modules 1, concrete may be grouted into the modules 1 to make the wall and/or column an integral and strong structure.

What is claimed is:

1. A precasted wall/column module comprising a rectangular hollow body formed from a four-side outer frame and an inscribed round pipe; said outer frame having a first end forming a first axially projected flange extending along an inner edge of said first end and a lowered outer edge extending around said first flange, and a second end forming a second axially projected flange extending along an outer edge of said second end and a lowered inner edge extending along an inner side of said second flange; axially extended insertion holes being correspondingly formed at every corner at said first and second ends; a thinned area being selectively provided on at least one side of said outer frame; and two semicircular openings being separately formed at two ends of said thinned area and a plurality of round holes being spaced between said two semicircular openings.

* * * * *